United States Patent [19]

Kiuchi

[11] 4,327,564

[45] May 4, 1982

[54] COLLAPSIBLE KNITTING MACHINE

[75] Inventor: Masaru Kiuchi, Hino, Japan

[73] Assignee: Silver Seiko Ltd., Kodaira, Japan

[21] Appl. No.: 159,463

[22] Filed: Jun. 16, 1980

[30] Foreign Application Priority Data

Jun. 21, 1979 [JP] Japan ..... 54-84122[U]

[51] Int. Cl.[3] ..... D04B 7/00

[52] U.S. Cl. ..... 66/60 H; 66/115

[58] Field of Search ..... 66/60 R, 60 H, 64, 115, 66/114

[56] References Cited

U.S. PATENT DOCUMENTS 3,124,946 3/1964 Hiromatsu ..... 66/60 H
3,407,630 10/1968 Moore ..... 66/114
4,238,937 12/1980 Nakaoka ..... 66/60 H

FOREIGN PATENT DOCUMENTS 36-26162 of 1961 Japan ..... 66/60 H

*Primary Examiner*—Ronald Feldbaum
*Attorney, Agent, or Firm*—Lane, Aitken, Kice & Kananen

[57] ABSTRACT

A collapsible flat bed knitting machine having a foldable needle bed and a carrying case for receiving therein the folded needle bed and other instrumentalities of the machine to facilitate transportation of the machine as of a portable sewing machine. Three parts or sections constituting the needle bed are foldably connected by an improved connector assembly having three plate members fixed respectively to the bed parts. The assembly connects the bed parts in their assembled position in sufficiently exact alignment to assure smooth traverse of a carriage on the thus completed needle bed.

14 Claims, 8 Drawing Figures

COLLAPSIBLE KNITTING MACHINE

BACKGROUND OF THE INVENTION

This invention relates to a hand-operated home knitting machine, and more particularly to a collapsible single flat bed home knitting machine in which a needle bed can be collapsed for facilitating transportation thereof.

A hand-operated knitting machine for domestic use is conventionally constructed as a single flat bed knitting machine which has a single straightened needle bed with a plurality of knitting needles such as latch needles being mounted for individual longitudinal movement in side by side relationship therein. Such a knitting machine now available in the market is typically about 112 cm long, 20 cm wide and 10 cm high, and has a weight of about 2.3 kg or so, when taken with a cover set on the needle bed in preparation for transportation of the machine. This considerable length will obviously have a bad effect on transportation facilities of the machine by a user, especially of a woman.

A collapsible knitting machine having a collapsible or foldable needle bed would facilitate transportation of the machine. A collapsible needle bed, however, may have a bad effect on the traverse of a carriage across the needle bed where it does not present an exactly straightened linear passage for the carriage. A conventional connector or joint structure such as a joint structure that employs one or more hinges which pivotally connect two or more needle bed parts or sections to form a collapsible needle bed may not provide such a straightened passage as will assure a satisfactorily smooth movement or traverse of the carriage on the straightened needle bed. Besides, either the size of the hinges or the space distance between adjacent knitting needles may be considerably limited since a hinge must be disposed within a spacing between two adjacent knitting needles so as not to interfere with the adjacent needles.

SUMMARY OF THE INVENTION

Accordingly, it is an object of the present invention to provide a collapsible flat bed knitting machine which has a collapsible or foldable needle bed consisting of two or more longitudinally divided needle bed parts which can be foldable to each other and also connectable contiguously to each other to form a unitary needle bed with the parts being kept in sufficiently exact alignment to assure smooth movement of a carriage on the thus formed needle bed.

According to the present invention, there is provided a collapsible flat bed knitting machine which comprises a needle bed including a major part and at least one minor part, a carriage slidably mounted on said needle bed, and connector means for foldably connecting said minor part to a longitudinal end of said major part in an aligned, contiguously assembled position to form a straightened unitary needle bed, said connector means including a first substantially rectangular plate member fixed on the bottom of said major part and having an end thereof extending outwardly from said longitudinal end of said major part, said connector means further including a second substantially rectangular plate member fixed on the bottom of said minor part and receivable by said first plate member in telescopic relationship for limited sliding movement relative thereto to maintain said minor part in sufficiently exact alignment with said major part to assure smooth sliding movement of said carriage on the thus assembled needle bed, said second member being extractable from a position fully retracted to said first member and being pivotable, at the fully extracted position thereof, to a vertical position relative to said first member around an axis which is spaced from said longitudinal end of said major part.

In one preferred embodiment of the invention, said needle bed includes a pair of minor parts disposed at opposite longitudinal ends of said major part, and said connector means includes correspondingly a pair of above defined second plate members provided at opposite longitudinal ends of said first plate member for individual operations thereof.

BRIEF DESCRIPTION OF THE DRAWINGS

The accompanying drawings show a preferred embodiment of the present invention, in which.

DETAILED DESCRIPTION OF THE PREFERRED EMBODIMENT

Figure 1:
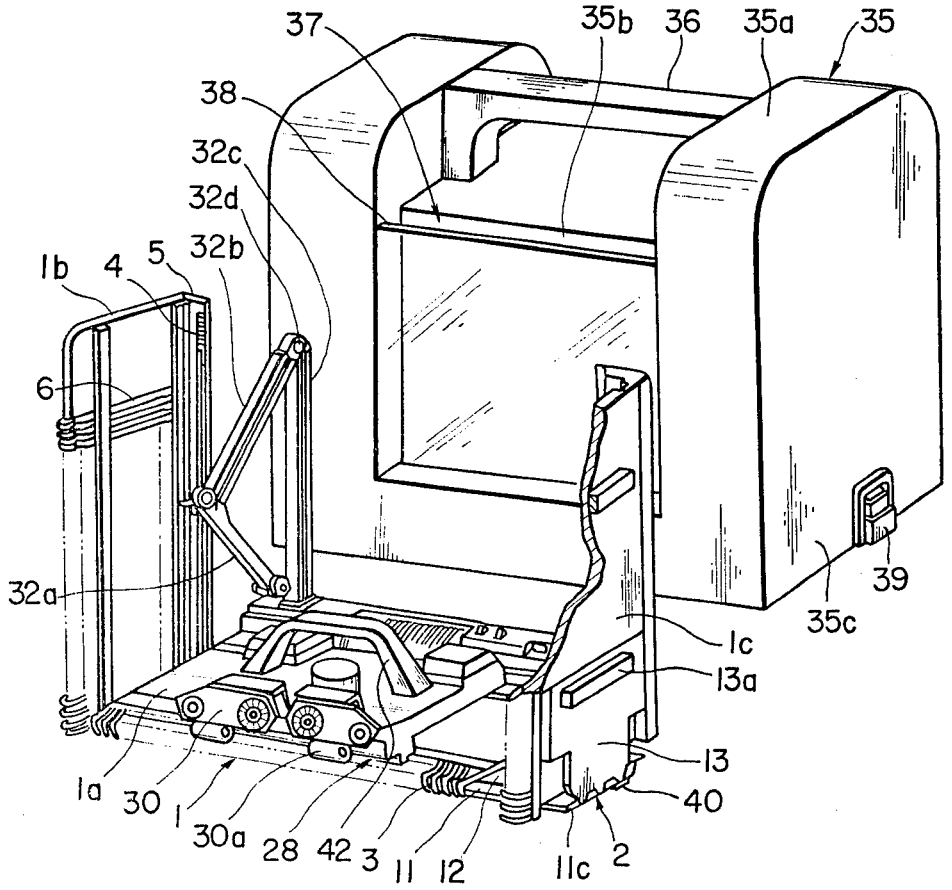
FIG. 1 is a perspective view, partly in section, of a collapsible knitting machine according to the present invention, showing the machine in a collapsed position ready for transportation thereof.
Figure 2:
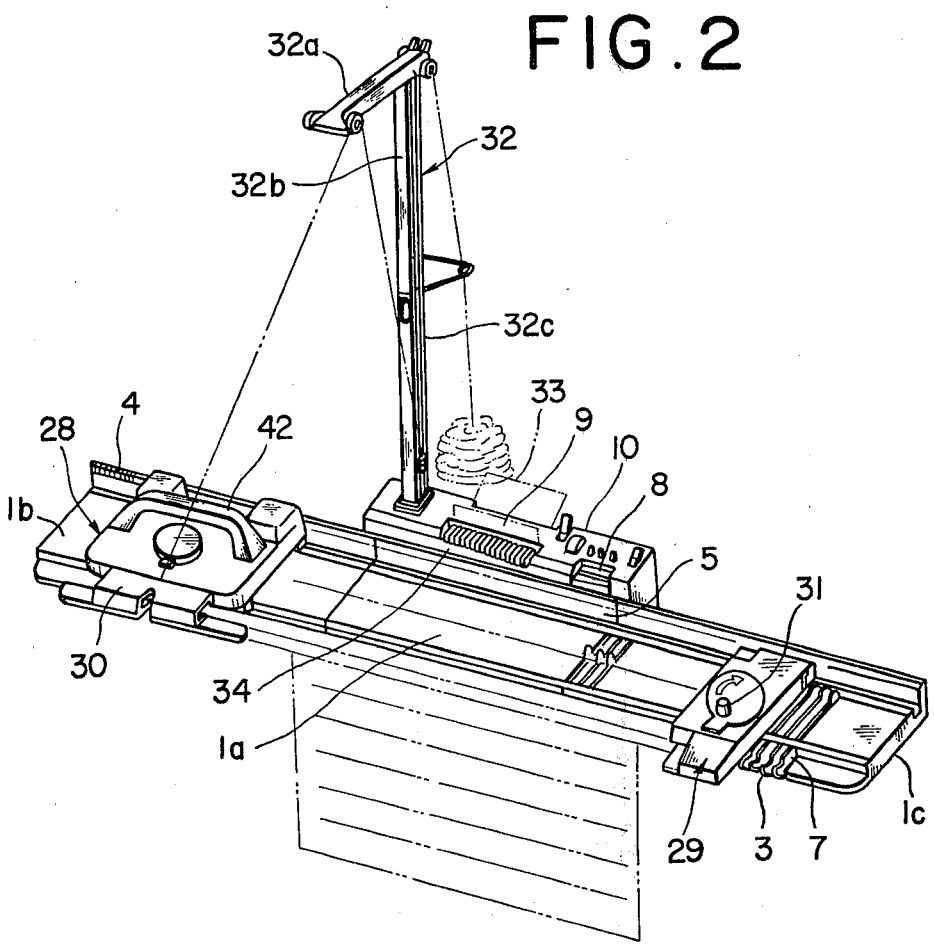
FIG. 2 is a perspective view of the knitting machine of FIG. 1, showing the machine in a position set for use thereof.

Referring first to FIGS. 1 and 2, there is illustrated a collapsible knitting machine embodying the present invention. The machine includes a needle bed generally designated at 1 on which a carriage generally designated at 28 is mounted for slidable movement on the needle bed 1 in the longitudinal direction. The machine further includes a carrying case generally designated at 35 in which the needle bed can be removably housed or received in its collapsed or folded state for facilitating transportation of the machine.

Figure 8:
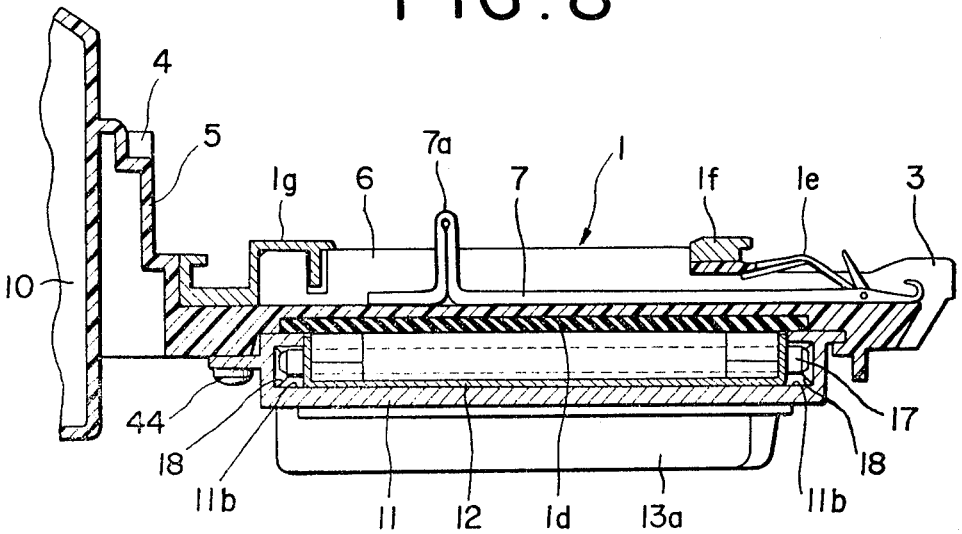
FIG. 8 is a sectional view substantially taken along line VIII—VIII of FIG. 4.

The needle bed 1 is made of a suitable synthetic resin material such as a kind of ABS resins and has a plurality of needle tricks 6 formed therein each for accommodating therein a knitting needle such as a latch needle 7 as shown in FIG. 8. Each knitting needle 7 has a butt 7*a* which is engageable by a cam mechanism (not shown) mounted on the bottom of the carriage 28, as in a conventional home knitting machine. A plurality of sinker elements 3 are fixed on the needle bed 1 along a forward edge thereof in alternate relationship with the knitting needles 7. An upright wall 5 is provided integrally with the needle bed 1 and extends along the opposite rear edge of the needle bed 1. The upright wall 5 has a plurality of teeth 4 formed on the top thereof that generally constitute a rack extending along the whole length of the needle bed 1 and adapted to drive some mechanisms such as needle selector drums (not shown) on the carriage 28 when the carriage 28 is slidably moved on the needle bed 1. The needle bed 1 further has front and rear rail members 1*f* and 1*g* (see FIG. 8) fixed thereon which extend along the whole length of the needle bed 1 and along which the carriage 28 is manually slided. A needle brake comb having a plurality of fingers 1*e* is fixed between the needle bed 1 and the front rail member 1*f* such that each finger 1*e* is resiliently biased to engage its free end with the top of the stem of a knitting needle 7 to provide an appropriate braking force to the needle 7.

The needle bed 1 which has a general construction as described above is divided along the length thereof into, in the preferred embodiment of the present invention, three sections or parts, namely, a major center part 1*a* and two minor end parts 1*b* and 1*c*. Both end parts 1*b* and 1*c* are connected to the center part 1*a* at the opposite longitudinal ends thereof by means of a joint or connector assembly generally designated at 2. This connector assembly 2 allows the end parts 1*b* and 1*c* to have an assembled position in which they are assembled with the center part 1*a* to form a unitary complete needle bed 1 as illustrated in FIG. 2 and another pivoted collapsed or folded position in which they are folded uprightly perpendicularly to the center part 1*a* as illustrated in FIG. 1, as hereinafter described in detail.

Figure 3:
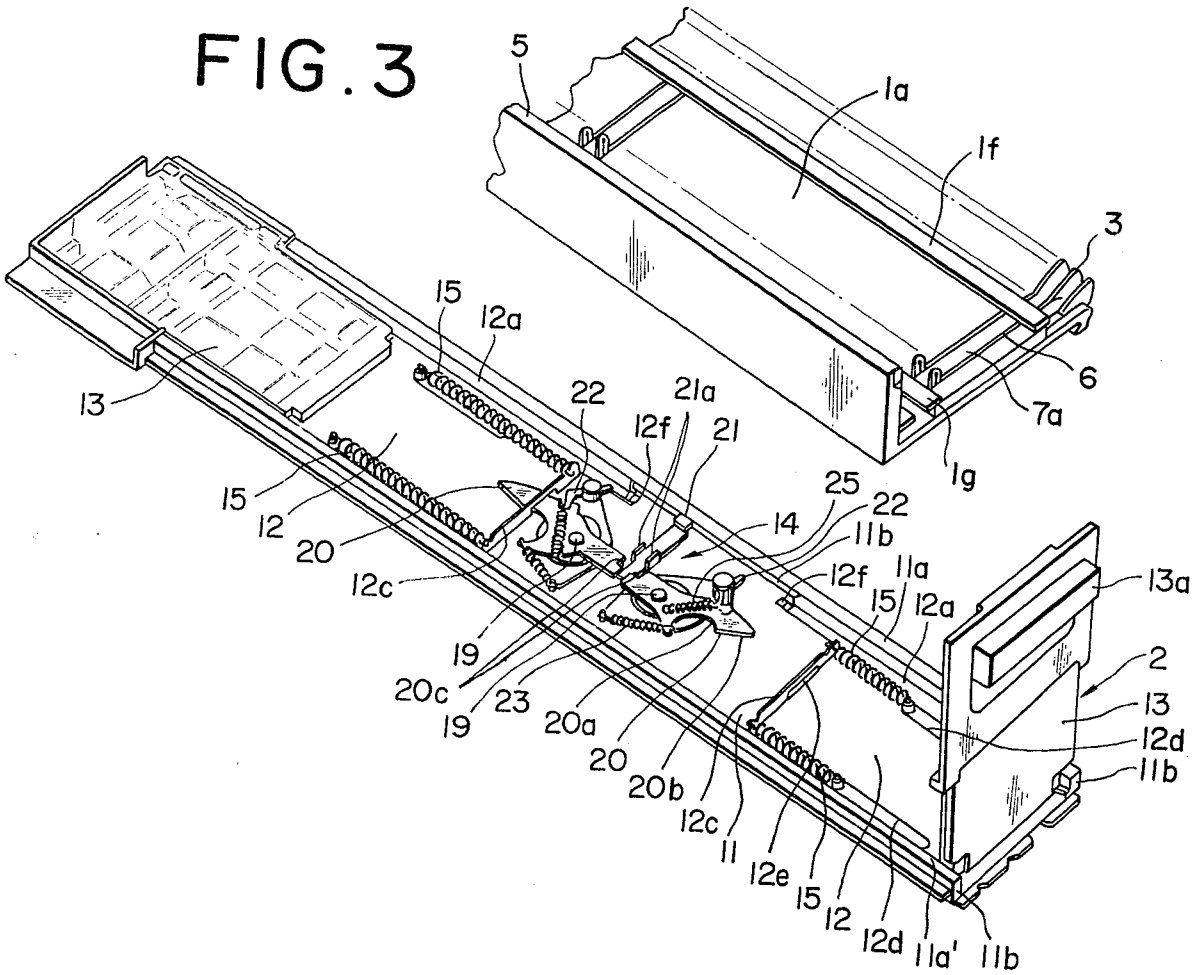
FIG. 3 is an enlarged left rear perspective view of part of the knitting machine, showing a connector assembly and a part of a needle bed in separated position.

Referring now to FIG. 3, the connector assembly 2 includes a base plate 11 which is fixed on the bottom of the center part 1*a* of the needle bed 1 by suitable fastening means such as fastening screws 44 (only one is shown in FIG. 8). A rubber sheet 1*d* may preferably be interposed between the needle bed part 1*a* and the base plate 11 for the sound insulation and buffering objects. The base plate 11 is substantially rectangular in plan and has along opposite longitudinal edges thereof front and rear wall sections 11*a* and 11*a*', leaving a widened channel-like spacing therebetween. Each of the wall sections 11*a* and 11*a*' has at the top thereof an inwardly directed extension to define a groove 11*b* for slidably receiving therein an end of a pivot shaft 17 (see also FIGS. 4, 5 and 8) which pivotally connects a flap 13 to a slide plate 12 provided at each longitudinal end of the base plate 11.

Figure 4:
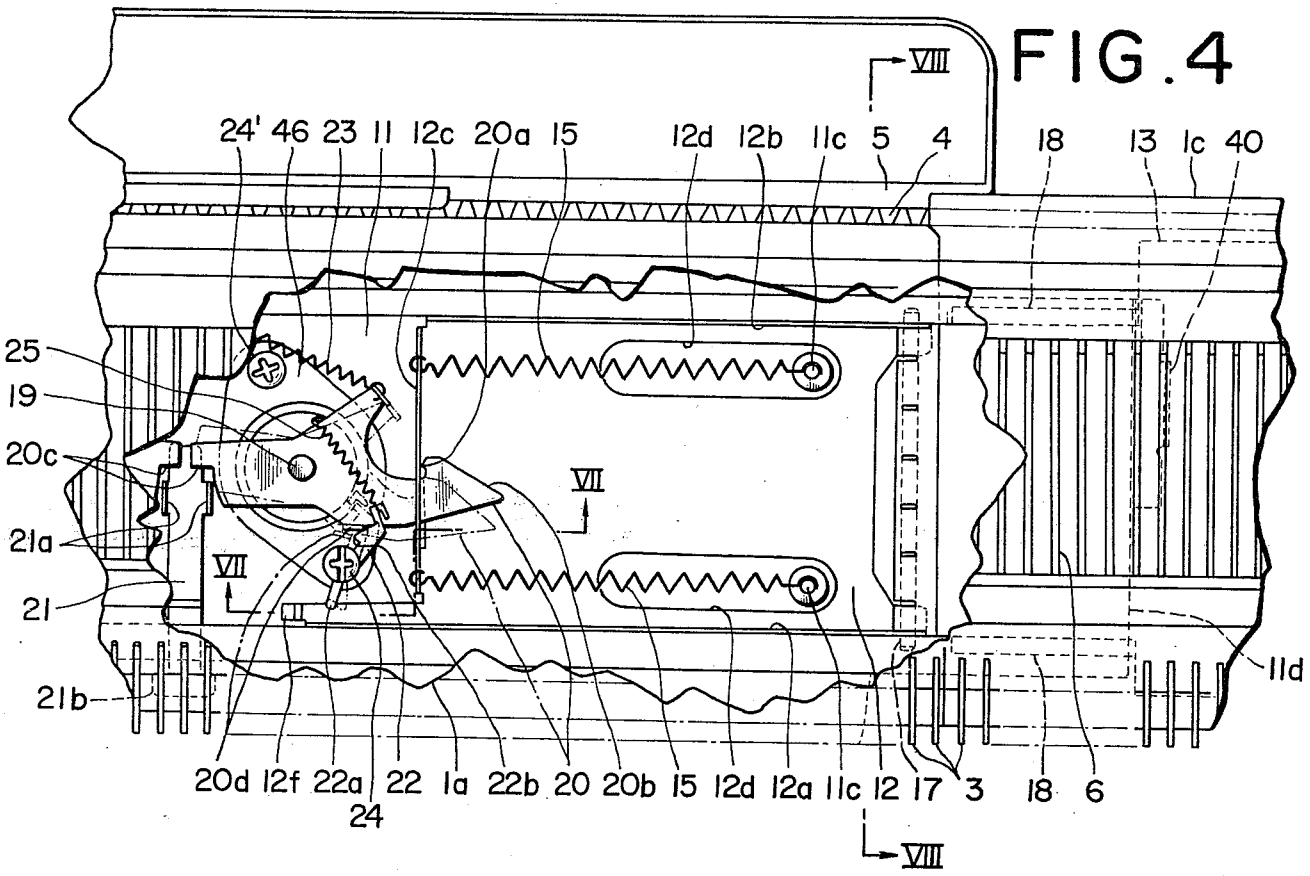
FIG. 4 is an enlarged fragmentary plan view of the knitting machine, partly broken to show details of part of the connector assembly of FIG. 3.

Referring to FIGS. 3 to 5 and 8, each slide plate 12 is substantially rectangular in plan and has front and rear walls 12*a* and 12*b* and an inner wall 12*c* formed along opposite longitudinal edges and an inner transverse edge thereof, respectively, as particularly seen from FIG. 4. The slide plate 12 is accommodated in the channel of the base plate 11 for longitudinal slidable movement therein and is urged longitudinally outwardly by means of a pair of tension springs 15 each extended between the inner wall 12*c* and a pin 11*c* fixed on the base plate 11. The pin 11*c* extends through an elongated hole 12*d* suitably formed in the slide plate 12 and provides a limit to longitudinal movement of the slide plate 12 relative to the base plate 11.

Figure 5:
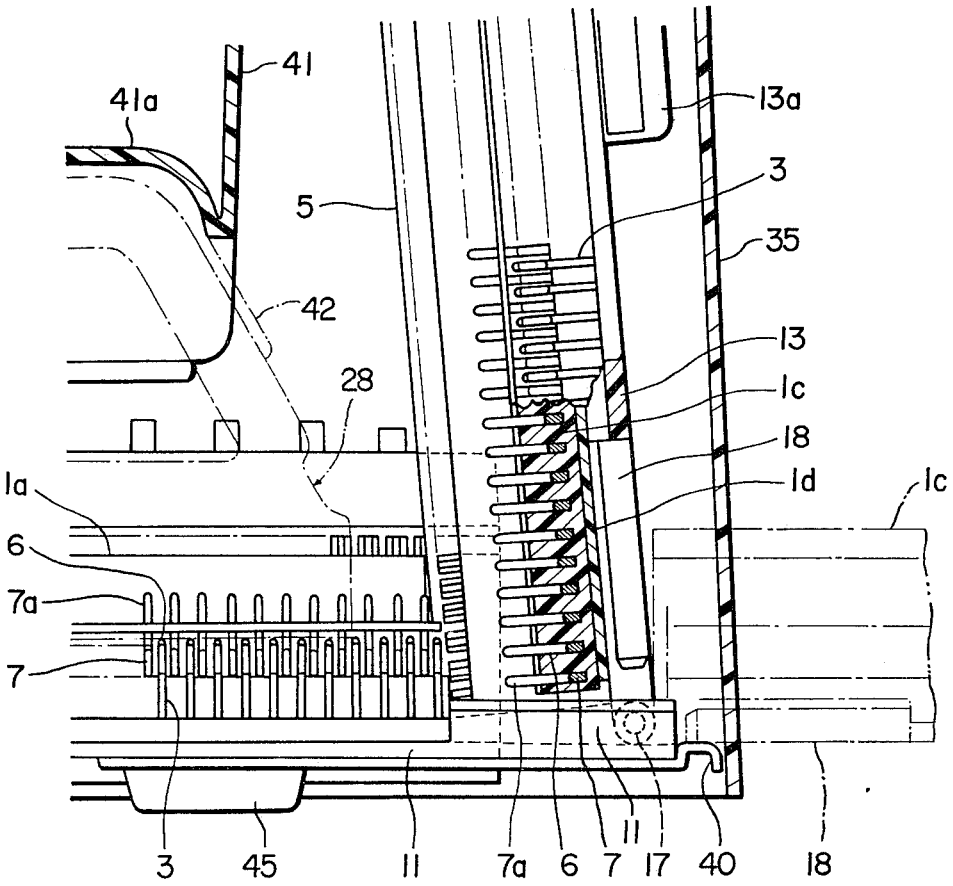
FIG. 5 is a fragmentary front view of the needle bed in a folded position.

Each flap 13 is substantially rectangular in plan and is secured to the bottom of the foldable end part 1*b* or 1*c* of the needle bed 1 (FIG. 1). As seen in FIGS. 5 and 8, the flap 13 is pivotally supported at the inner end thereof by the aforementioned pivot shaft 17 which extends through the longitudinal walls 12*a* and 12*b* of the slide plate 12 into the grooves 11*b* in the longitudinal walls 11*a* and 11*a*' of the slide plate 11. The flap 13 has an elongated protrusion 13*a* formed on the bottom thereof which serves as a foot for supporting the machine on a working table (not shown) together with foot members 45 (only one is shown in FIG. 5) attached to the bottom of the base plate 11. A pair of laterally extending ribs 18 are formed along inner portions of front and rear edges of the flap 13 such that they can be slidably fitted in the grooves 11*b* of the base plate 11 to thus hold the flap 13 in a position aligned with the base plate 11 as shown by the left hand side one of the flaps 13 in FIG. 3 whereas they can be thoroughly withdrawn from the base plate 11 so that the flap 13 can be pivoted around the pivot shaft 17 from a horizontal to a folded upright position as shown by the right hand side flap 13 in FIG. 3.

During use of the machine, the end parts 1*b* and 1*c* are both assembled to the center part 1*a* to form a complete needle bed 1 as shown in FIG. 2. In this position of the needle bed 1, both slide plates 12 together with the flaps 13 are releasably retained in their respective innermost positions by means of a locking or latching mechanism generally designated at 14 which will be hereinafter described in detail. In folding or collapsing the needle bed 1, the latching mechanism 14 is first manually operated to release the slide plates 12 so that the needle bed end parts 1*b* and 1*c* may thereafter be manually withdrawn from the center part 1*a* in horizontal outward directions to their outermost positions determined by the pins 11*c* and the slide plate 12. Alternatively, the springs may be strong enough to move the needle bed end parts 1*b* and 1*c* to their outermost positions together with the slide plates 12 and the flaps 13. The end parts 1*b* and 1*c* are then manually lifted or pivoted around the pivot shaft 17 to their upright positions as shown in FIG. 1. On the contrary, in setting the needle bed 1 for preparation for use from its collapsed position, the needle bed end parts 1*b* and 1*c* are manually pivoted from the upright to horizontal positions and are then pushed inwardly towards the center part 1*a* to their innermost positions at which they are latched by the latching mechanism 14 to thus form a complete needle bed 1 as shown in FIG. 2.

In order to permit the needle bed end parts 1*b* and 1*c* to be pivoted without interfering with the center part 1*a*, the base plate 11 is extended beyond the opposite longitudinal ends of the needle bed center part 1*a* as at 11*d* in FIG. 4. Each extension 11*d* has a sufficient length to provide to the fully pulled out end part 1*b* or 1*c* a pivotal axis, that is, the pivot shaft 17, which is spaced from the center part 1*a* a distance greater than the height of the end part 1*b* or 1*c*, that is, the height of the upright rear wall 5 of the end part as taken from the pivot shaft 17, as seen from FIG. 5. Thus, a portion of the upright wall 5 of the end part 1*b* or 1*c* may abut against the upright wall 5 of the center part 1*a* which thus prevents further inward pivotal motion of the end part 1*b* or 1*c*, also as seen in FIG. 5.

It is to be noted that the ribs 18 of the flaps 13, all made rigid, are designed to have an utmost intimate fitting relationship with the groove 11*b* portions of the base plate 11, also made rigid, so long as a smooth sliding movement thereof on the latter can be ensured and have a considerable length since this is considerably effective for the connector assembly 2 to prevent transverse deflection of the needle bed 1 to maintain the component parts 1*a*, 1*b* and 1*c* thereof in an exact alignment with each other during use of the machine.

Referring to FIGS. 3, 4 and 8, the aforementioned locking mechanism 14 is located at the center of and in the channel-like spacing of the base plate 11. The mechanism 14 includes a pair of locking or latching members or levers 20 pivotally supported on the base plate 11 by pins 19. Each locking lever 20 has a first outer arm which has a hooked edge 20*a* formed thereon and normally extends through an elongated opening 12*e* formed in the inner wall 12*c* of the slide plate 12 in its innermost position. The locking lever 20 further has an inclined camming portion 20*b* formed on an outer rear edge of the first arm thereof. A spring 23 normally urges the latching lever 20 to a latching position in which the hooked edge 20*a* is engaged with a marginal edge portion of the opening 12*e* of the base plate 12 to latch or retain the slide plate 12 in its innermost position against the urging of the springs 15, as indicated in solid line in FIG. 4. The latching lever 20 has a second inner arm having thereon a stepped portion 20*c* which is opposed to a bent lug 21*a* formed on an operating bar 21. The operating bar 21 is mounted for back and forth movement at the center of the base plate 11 and has a knob 21*b* attached thereto and exposed outside the base plate 11 for manual operation thereof.

Upon rearward manual movement of the operating bar 21, the bent lugs 21*a* thereon are engaged with the stepped portions 20*c* of the latching levers 20 to pivot the levers 20 from their latching position to an unlatching position (indicated in phantom in FIG. 4) against the urging of the springs 23 to thus release the slide plates 12 to permit the needle bed end parts 1*b* and 1*c* to be pulled out from the center part 1*a*. On the other hand, upon inward push of each end part 1*b*, 1*c* towards the center part 1*a*, the marginal edge portion of the opening 12*e* of the slide plate 12 is engaged with the inclined camming edge 20*b* of the latching lever 20 to pivot the lever 20 towards its unlatching position against the urging of the spring 23 so that the slide plate 12 and hence the end part 1*b*, lc are permitted to return to its innermost position latched by the latching lever 20.

In order to eliminate the necessity of very accurate positioning of a latching lever 20 relative to a slide plate 12 particularly in the moving direction of the plate 12, the latching edge 20*a* of the lever 20 is preferably somewhat inclined relative to the inner wall 12*c* of the slide plate 12. Also, each pin 19 pivotally supporting a latching lever 20 is preferably fixed on a support plate 46 which is mounted for adjustment in the moving direction of the slide plate 12 on the base plate 11 by a pair of fastening screws 24 and 24'. Such adjustment may be attained, for example, by providing an elongated hole (not shown) in the support plate 46 through which a fastening screw, such as at 24', is extended to the base plate 11.

Means is provided to the locking mechanism 14 for releasably latching each locking lever 20 to its unlatching position to facilitate pulling out of the needle bed end part 1*b*, 1*c* at any time after the operating bar 21 has been manually operated once. The latching means includes a latching or arresting member or lever 22 pivotally mounted on the fastening screw 24. The arresting lever 22 has a hooked portion 22*b* formed thereon and is urged by a spring 25 tensioned between the lever 22 and the latching lever 20 to a position in which the hooked portion 22*b* thereof is engaged with a bent lug 20*d* formed on the latching lever 20 to arrest the lever 20 in its unlatching position, as shown in phantom in FIG. 4.

Figure 7:
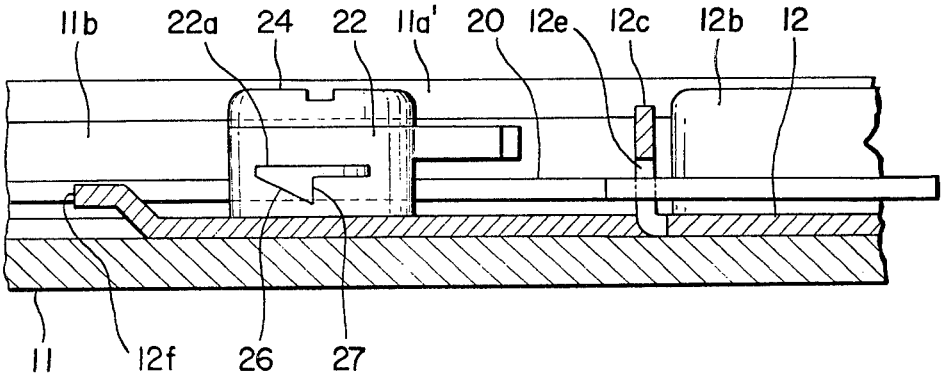
FIG. 7 is an enlarged sectional view substantially taken along line VII—VII of FIG. 4.

When the latching lever 20 is pivoted against the urging of the spring 23, it releases the slide plate 12 as described above and concurrently the bent lug 20*d* thereof is engaged with an inclined edge adjacent to the hooked portion 22*b* of the arresting lever 22 to pivot the lever 22 against the urging of the spring 25 until it is received by the hooked portion 22*b*. Thus, the latching lever 20 is held arrested by the arresting lever 22 after the operating lever 21 is released. The needle bed end parts 1*b* and 1*c* can therefore be pulled from the center part 1*a* at any time since then. On the other hand, upon inward push of the needle bed end part 1*b*, 1*c* towards the center part 1*a*, an end face of an inner longitudinal extension 12*f* of the slide plate 12 is engaged with a vertical face 27 (see FIG. 7) of an arm 22*a* of the arresting lever 22 to pivot the lever 22 against the urging of the spring 25 to thus release the latching lever 20 from the position arrested by the arresting lever 22 to return to its latching position. The extension 12*f* is offset near to its inner end to dispose the end face thereof in level with the vertical face 27 of the arresting lever 22. The arm 22*a* of the arresting lever 22 has a lower inclined face 26 adjacent to the vertical face 27 thereof and has such a suitable flexibility that, when the offset portion of the slide plate extension 12*f* is engaged with the inclined face 26 of the arm 22*a* during outward movement of thee slide plate 12 from the innermost position, the arm 22*a* is yieldably deflected upwardly to thus permit the offset extension 12*f* to pass under the same, allowing the latching lever 20 to be held arrested by the arresting lever 22.

Figure 6:
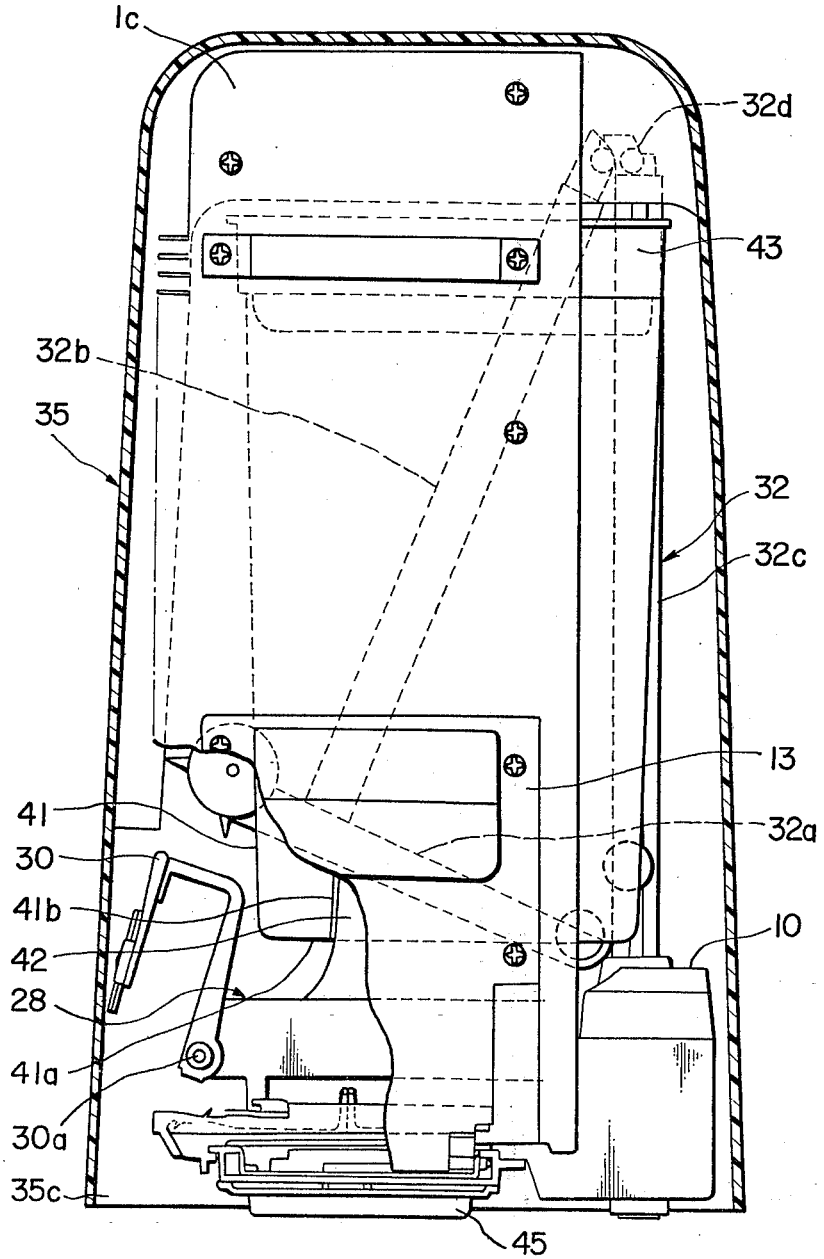
FIG. 6 is a right-hand side view, partly in section, of the machine in the collapsed position ready for transportation thereof, showing a carrying case in section.

The knitting machine embodying the present invention includes further components which are collapsible so as to be housed in or covered with the carrying case of the machine. Referring to FIGS. 1, 2 and 6, the carriage 28 has a foldable fabric presser 30 which is hinged to the carriage 28 as at 30*a* and is pivotable between a horizontal position ready for use as shown in FIG. 2 and another upright folded position as shown in FIGS. 1 and 6. Thus, the carriage 28 can be set for transportation without the necessity of removing the fabric presser from the carriage as in a conventional home knitting machine.

A yarn take-up device generally designated at 32 is also arranged foldable or collapsible in order that it can be set for transportation without removing the device from the machine as in a conventional home knitting machine. The device 32 includes, in its general construction, a top horizontal section 32*a*, an upper vertical section 32*b* having the top section 32*a* attached thereto, and a lower vertical section 32*c* connected to the upper section 32*b* by a joint arrangement 32*d*. In use, the upper part 32*b* is retained uprightly in alignment with and contiguously to the lower section 32*c* as shown in FIG. 2, whereas it can be pulled a limited distance from the lower section 32*c* and then folded at the joint arrangement 32*d* as shown in FIGS. 1 and 6 when the machine is to be set for transportation. The joint assembly 32*d* thus providing such a folding facility may be obtained by application of a structure employed in the aforementioned needle bed connector assembly 2.

The take-up device 32 is fixed, at the lower end of the lower section 32*c* thereof, to a frame member 10 generally formed as an elongated box which may be formed by molding integrally with the aforementioned needle bed center part 1*a* as seen from FIG. 8 or otherwise fixed to the center part 1*a* by a suitable fastening means behind the upright wall 5 of the center part 1*a*. A conventional row counter 8 and a patterning program providing device 9 are also provided on the frame member 10. The patterning program providing device 9 may be of any conventional type, such as of the type provided with a set of feeler levers 34 adapted to mechanically sense or read a row of perforations selectively punched on a card or sheet as at 33 known as a perforated needle selection program card in a punch card type needle selection mechanism of a knitting machine. A needle selector means (not shown) provided on the carriage 28 may select needles 7 in accordance with the readings by the feeler levers 34 during a sliding movement of the carriage 28 on the needle bed 1.

In FIG. 6, there is illustrated the knitting machine housed in the carrying case 35 with the needle bed 1, the carriage 28 and the yarn take-up device 32 collapsed in position. The case 35 is made of a suitable synthetic resin material and is designed and dimensioned to receive the machine in folded state. The case 35 is open at the bottom thereof and has a handle 36 formed centrally of and integrally with a top wall 35*a* thereof. A transparent plate 38 of a suitable synthetic resin material is fitted at an indented center portion 35*b* of a front wall of the case 35 to thus define a pocket 37 for receiving therein patterning program cards, an instruction book, pattern sheets, and so on. The case 35 further has buckles 39 of a conventional type fixed centrally at lower end portions of opposite side walls 35*c* thereof. The buckles 39 are cooperable with hook plates 40 (only one is shown at FIG. 5) attached to opposite ends of the base plate 11 to releasably fasten the case 35 to the needle bed 1.

Referring to FIGS. 1, 5 and 6, the carriage 28 can be fixed to the needle bed center part 1*a* by a suitable means (not shown) when prepared for transportation of the machine. Within a spacing defined by the carriage 28 thus fixed, the needle bed end parts 1*b* and 1*c*, and the top and front and rear walls of the case 35, there is disposed an accessory box 41 for accommodating therein a loop manipulator, weights, scales and other accessories or device for use with the machine. (A loop manipulator is illustrated in FIG. 2 and generally designated as at 29. The device 29 is used for linking one or more rows of loops of one or more knitted fabrics on the machine by manual operation of a handle 31 provided on the device 29.) The box 41 has its bottom 41*a* convexed upwardly as at 41*b* and a handle 42 of the carriage 28 extends into the convexed portion 41*b* to support the accessory box 41 thereon, as particularly seen in FIG. 5. A tray 43 in which relatively small tools or devices such as transfer tools, tappet tools, a cast-on wire, and so on, are to be placed during use of the machine is removably fitted in the upper opening of the accessory box 41 as a cover for the box 41 for transportation of the machine.

What is claimed is:

1. A collapsible flat bed knitting machine, comprising a needle bed including a major part and at least one minor part, a carriage slidably mounted on said needle bed, and connector means for foldably connecting said minor part to a longitudinal end of said major part in an aligned, contiguously assembled position to form a straightened unitary needle bed, said connector means including a first substantially rectangular plate member fixed on the bottom of said major part and having an end thereof extending outwardly from said longitudinal end of said major part, said connector means further including a second substantially rectangular plate member fixed on the bottom of said minor part and receivable by said first plate member in telescopic relationship for limited sliding movement relative thereto to maintain said minor part in sufficiently exact alignment with said major part to assure smooth sliding movement of said carriage on the thus assembled needle bed, said second member being extractable from a position fully retracted to said first member and being pivotable, at the fully extracted position thereof, to a vertical position relative to said first member around an axis which is spaced from said longitudinal end of said major part.

2. A collapsible flat bed knitting machine as claimed in claim 1, wherein said first plate member has a pair of longitudinally extending parallel slots or grooves formed therein which relatively intimately receive longitudinal opposite edges of said second plate member such that said second plate member can slidably move on and relative to said first plate member, and said connector means further includes pivot means slidably received in said slots and providing a pivotal axis around which said second plate member is pivoted to said vertical position so that said minor part may be pivoted from a protruded horizontal to a collapsed vertical position.

3. A collapsible flat bed knitting machine as claimed in claim 1 or 2, wherein said connector means further includes a spring normally urging said second plate member from the retracted to said protruded position, and a manually releasable latching means normally latching said second plate member in said retracted position against the urging of said spring and manually operable to permit said second plate member to be released from the latched retracted position.

4. A collapsible flat bed knitting machine as claimed in claim 3, wherein said spring has an urging force strong enough to move said second plate member from said retracted to said protruded position together with said minor needle bed part when said second plate member is released from said latching means.

5. A collapsible flat bed knitting machine as claimed in claim 2, wherein said connector means further includes a third plate member accommodated for limited longitudinal movement in a channel formed in said first plate member in the longitudinal direction thereof, said third plate member having its one end pivotally connected to an end of said second plate member by means of said pivot means.

6. A collapsible flat bed knitting machine as claimed in claim 5, wherein said connector means further includes a manually releasable latch lever pivotally mounted on said first plate member and having a latching position in which it latches said third plate member to hold said second plate member in said retracted position, said latch lever being manually operable to permit said third plate member to be released therefrom, and a spring extended between said first plate member and said latch lever to urge said latch lever to said latching position.

7. A collapsible flat bed knitting machine as claimed in claim 6, wherein said latch lever has a camming edge disposed inclined such that it is engaged by said third plate member moving to its latched position to pivot said latch lever away from said latching position against the urging of said spring to thereafter permit said latch lever to be returned to its latching position when said third plate member is returned to its latching position.

8. A collapsible flat bed knitting machine as claimed in claim 6, wherein said connector means further includes a second latch lever pivotally mounted on said first plate member and having a latching position in which it latches the first-mentioned latch lever to an unlatching position against the urging of said spring, and a spring normally urging said second latch lever to said latching position, said second latch lever being brought out of said latching position in response to arrival or movement to said latched position of said third plate member to permit said first latch lever to be returned to said latching position.

9. A collapsible flat bed knitting machine as claimed in any one of the preceding claims, wherein said first or second plate member has a projection formed thereon which serves as a foot for supporting the machine in a position for use on a working table.

10. A collapsible flat bed knitting machine as claimed in any one of the preceding claims, further comprising a carrying case for receiving therein the collapsed needle bed together with said carriage mounted on said needle bed major part to facilitate transportation of the machine.

11. A collapsible flat bed knitting machine as claimed in claim 10, further comprising an accessory box for receiving therein attachments or accessories for use with the knitting machine such as a tappet tool, a cast-on device, weights, and so on, said accessory box being disposed within a spacing defined by said carriage on said needle bed major part, said minor needle bed part in its collapsed vertical position, and said carrying case when the machine is collapsed for transportation thereof.

12. A collapsible flat bed knitting machine, comprising a needle bed including a major part and a pair of minor parts, a carriage slidably mounted on said needle bed, and connector means for foldably connecting said minor parts to opposite longitudinal end of said major part in an aligned, contiguously assembled position to form a straightened unitary needle bed, said connector means including a first substantially rectangular plate member fixed on the bottom of said major part and having opposite ends thereof extending outwardly from said opposite ends of said major part, said connector means further including a pair of second substantially rectangular plate members each fixed on the bottom of one of said minor parts and receivable by said first plate member in telescopic relationship for limited sliding movement relative to thereto to maintain said minor parts in sufficiently exact alignment with said major part to assure smooth sliding movement of said carriage on the thus assembled needle bed, said second members being individually extractable from a position fully retracted to said first member and each pivotable, at the fully extracted position thereof, to a vertical position relative to said first member around an axis which is spaced from any of said longitudinal ends of said major part.

13. A collapsible flat bed knitting machine as claimed in claim 12, further comprising a carrying case for receiving therein the collapsed needle bed together with said carriage mounted on said major part of said collapsed needle bed to facilitate transportation of the knitting machine.

14. A collapsible flat bed knitting machine as claimed in claim 13, further comprising an accessory box for receiving therein attachments or accessories for use with the knitting machine such as a tappet tool, a cast-on device, weights, and so on, said accessory box being disposed within a spacing defined by said carriage on said major needle bed part, said minor needle bed parts in their collapsed vertical position, and said carrying case when the machine is collapsed for transportation thereof.

* * * * *